US006250243B1

(12) United States Patent
Wierli et al.

(10) Patent No.: US 6,250,243 B1
(45) Date of Patent: Jun. 26, 2001

(54) ARRANGEMENT FOR TURNING A TURRET ON A SHIP

(75) Inventors: Olav Wierli, Tranby; Knut E. Borseth, Tarnasen; Hans Oigarden, Oslo, all of (NO)

(73) Assignee: dsc Engineering AS, Tranby (NO)

( * ) Notice: Subject to any disclaimer, the term of this patent is extended or adjusted under 35 U.S.C. 154(b) by 0 days.

(21) Appl. No.: 09/446,712

(22) PCT Filed: Jun. 26, 1998

(86) PCT No.: PCT/NO98/00196

§ 371 Date: Feb. 22, 2000

§ 102(e) Date: Feb. 22, 2000

(87) PCT Pub. No.: WO99/00294

PCT Pub. Date: Jan. 7, 1999

(30) Foreign Application Priority Data

Jun. 26, 1997 (NO) ..... 972986

(51) Int. Cl.[7] ..... B63B 21/00
(52) U.S. Cl. ..... 114/230.12
(58) Field of Search ..... 114/230.12; 441/3–5

(56) References Cited

U.S. PATENT DOCUMENTS 3,774,562 11/1973 Dean, III ..... 114/0.5 D
4,753,553 * 6/1988 Carlsen et al. ..... 114/230.12
5,762,017 6/1998 Groves ..... 114/230

FOREIGN PATENT DOCUMENTS 0 207 915 A1 1/1987 (EP) .
WO 96/06001 A1 2/1996 (WO) .

* cited by examiner

*Primary Examiner*—Sherman Basinger
(74) *Attorney, Agent, or Firm*—Libert & Associates

(57) ABSTRACT

An arrangement for turning a turret on a ship comprises two slides that can glide along a flange arrangement being arranged on a rim of a turret. The slides are moveable by respective hydraulic cylinders and provide support for a rotatable pawl arrangement which can be rotated into and out of engagement with apertures in the rim. The two hydraulic cylinders are arranged as mirror images of each other in order for the cylinders to push the rim in opposite directions. When the turret is turned, one of the hydraulic cylinders, with the associated slide and pawl arrangement, is used to push the rim in the desired direction, while the other hydraulic cylinder with associated slide and pawl arrangement is utilized to hold the rim in a fixed position while the first slide is pulled back in order for the pawl arrangement to engage with a new aperture in the rim.

27 Claims, 4 Drawing Sheets

ARRANGEMENT FOR TURNING A TURRET ON A SHIP

BACKGROUND OF THE INVENTION

1. Field of the Invention

The present invention relates to an arrangement for turning a turret on a ship.

2. Related Art

The present invention relates to an arrangement for turning a turret on a ship, and in particular to an arrangement having hydraulic driving cylinders.

One such arrangement is known from United Kingdom Patent 2 307 891, granted on application PCT/NO95/00124 and entitled "Arrangement for Supporting and Controlling a Vehicle in Relation to a Corresponding Turret", the contents of which are incorporated herein by reference. In this publication the two units are positioned substantially tangentially to the rim, and are connected to a space consuming structure outside of the rim. The slide, which is referred to as clamping means, is slideably arranged on the rim and is "forced to a tilted about position in order to be clamped in a clamping engagement about a T-shaped guide ring" by an outwardly directed pressure force from the related hydraulic cylinder. Here it may seem like the clamping engagement is caused by a wedging of the slide on the guiding ring. A such wedging action can be maintained only if the hydraulic cylinder excercises a sufficient force, something that cannot be guaranteed in all circumstances, and the predictability of such a system is thereby not satisfactory. Furthermore, the engagement between the slide and the rim is based on frictional forces and thereby very large pressure forces against the rim, which quickly can cause wear and flattening of the material in the contact surfaces.

SUMMARY OF THE INVENTION

The object of the present invention is thus to avoid the above-mentioned disadvantages and at the same time obtain savings with regard to space, weight and costs.

This invention provides an arrangement for turning a turret on a ship, the turret comprising a rim having a flange arrangement thereon. There is at least one slide that can glide along the flange arrangement and optionally be locked onto the rim. The slide is driven by a hydraulic cylinder acting between the slide and the structure of the ship. The slide, together with the related hydraulic cylinder, forms one unit of a pair of such units, the two units acting in substantially opposite directions on the rim and preferably being controlled by a mutual control system which can cause one of the hydraulic cylinder units to remain locked while the other unit is moved by its hydraulic cylinder.

For a better understanding of the invention, it is now described more closely with reference to the exemplifying embodiment shown in the accompanying drawings, where:

DETAILED DESCRIPTION OF THE INVENTION AND SPECIFIC EMBODIMENTS THEREOF

Figure 1:
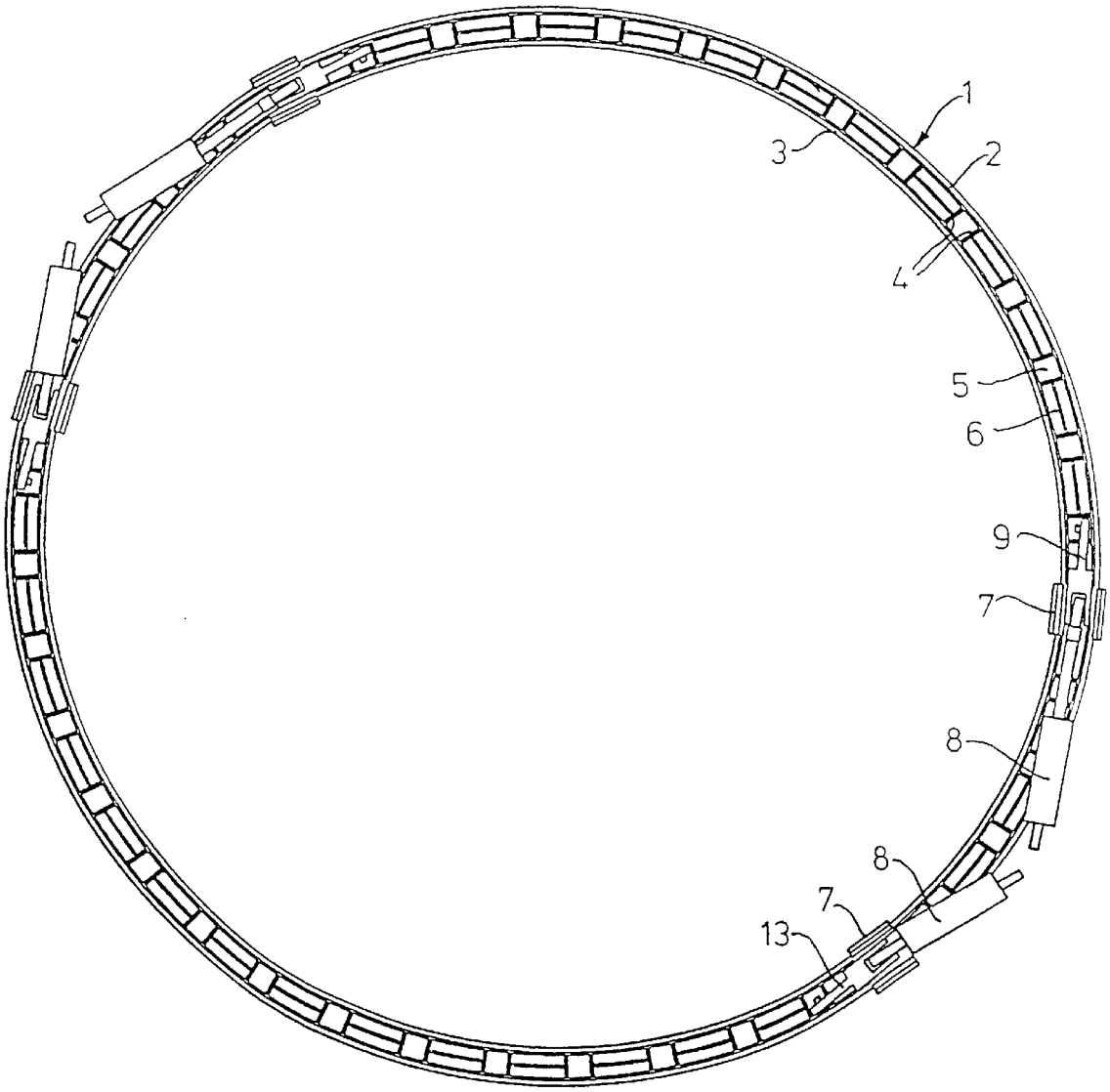
FIG. 1 shows a plan view, seen from below, of a rim on a turret provided with arrangements according to the invention.

It is first referred to FIG. 1, showing a rim 1, seen from below, of a turret that is known to a person skilled in the art and therefore omitted for the sake of clarity. The rim 1 has a flange arrangement comprising an outer ring 2 and an inner ring 3, forming between them a groove defining apertures 5 by means of transverse blocks 4. Between the apertures 5, webs 6 are welded in place, e.g., for supporting the blocks 4.

The arrangement according to the invention comprises a slide 7 glideably arranged on the rim. The slide 7 is rotatably connected to a hydraulic cylinder 8 in order to be moved together with , or along, the rim 1, depending on whether the slide is locked onto the rim by a pawl arrangement 9.

Figure 2:
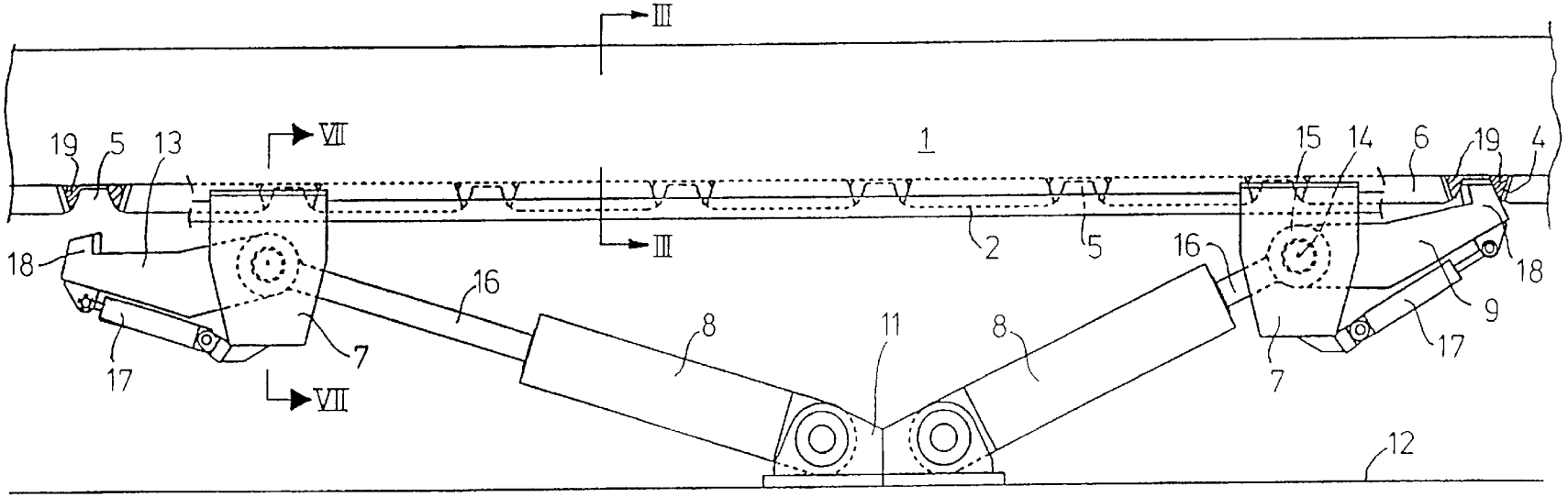
FIG. 2 shows a side view of a portion of the rim in FIG. 1 provided with an arrangement according to the invention.

Further details of the arrangement according to the invention is shown in FIG. 2. It is seen that the arrangement comprises two symmetrical units on the right hand and the left hand side, respectively, of a mutual fixing bracket 11 (not shown in FIG. 1), which is connected to the deck 12 of the vessel. Similar parts of the two units are given the same reference numerals. Thus, it is seen that the pawl arrangements are different, the right pawl arrangement 9 and the left pawl arrangement 13 being mirror images of each other.

The pawl arrangements 9, 13 are ratably supported in their respective slides 7, and their axis 14 of rotation is concentric with the attachement lug 15 of the piston rod 16 of the hydraulic cylinder 8 (this support is described further below with reference to FIG. 7). The pawl arrangements 9, 13 are moved by a swinging cylinder 17, in order for the pawl to be brought into and out of engagement with an aperture 5 in the rim 1. For this engagement the pawl arrangement has a hook-shaped nose portion 18, the shape being described below with refrence to FIG. 5 and 6. The same applies to a nearly wedge-shaped abutment element 19 placed in the apertures 5.

Figure 4:
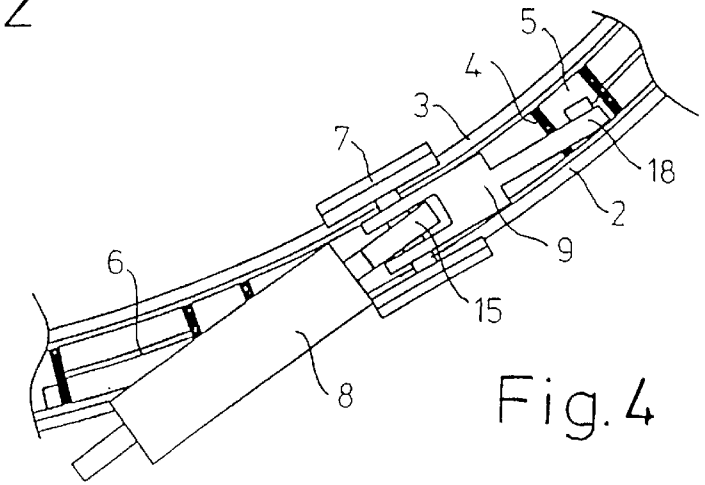
FIG. 4 shows a portion of FIG. 1 on a larger scale.
Figure 3:
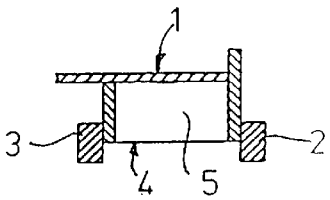
FIG. 3 shows a sectional view along the line III—III on FIG. 2.

FIG. 3 shows a section through the rim 1 and illustrates the rims 2 and 3, defining together with the blocks 4 the apertures 5 for the nose portion 18 of the pawl arrangements. FIG. 4 shows one of the right hand side units in FIG. 1 on a larger scale.

Figure 5:
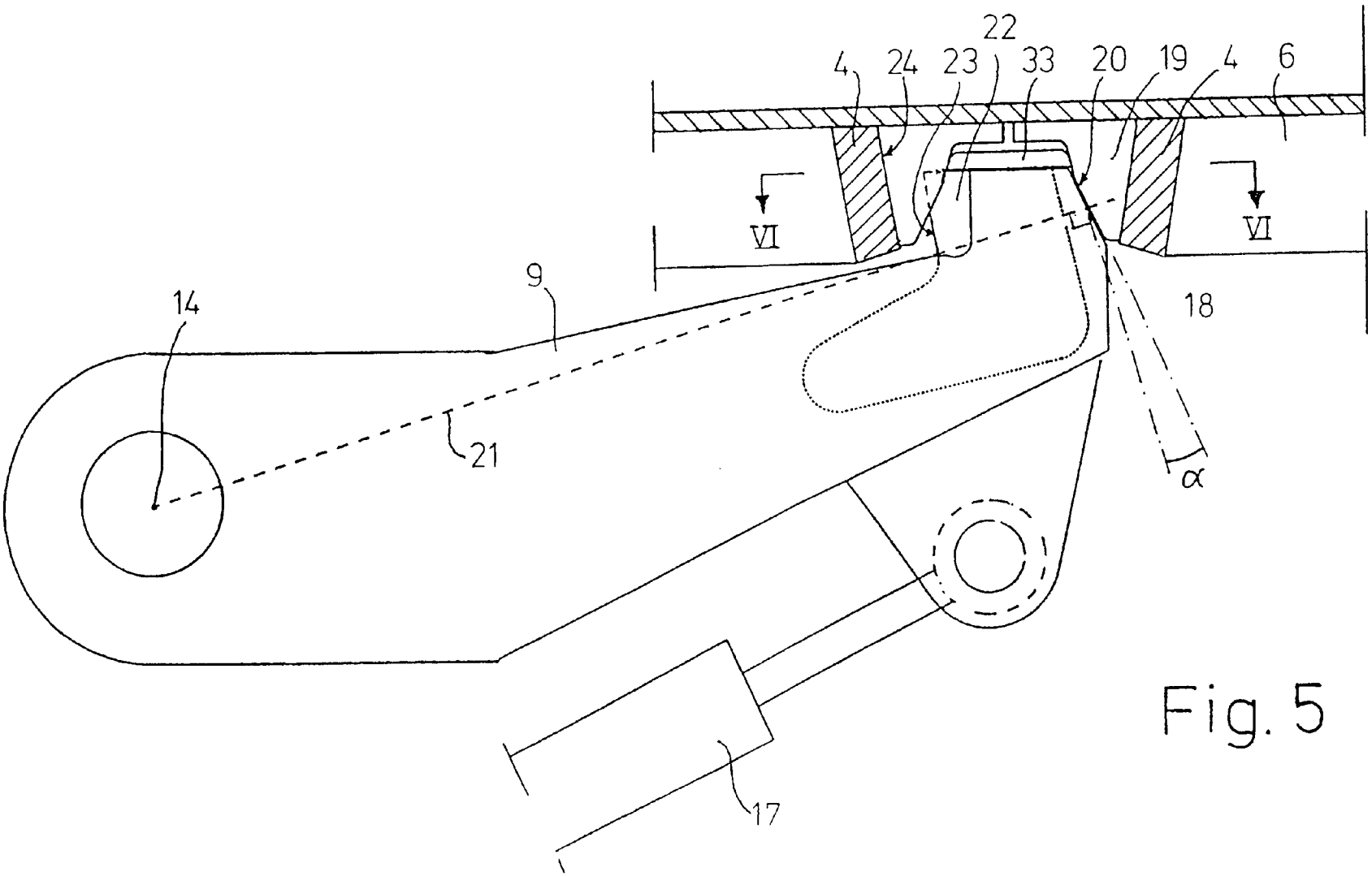
FIG. 5 is a sectional view along the line V—V in FIG. 6.
Figure 6:
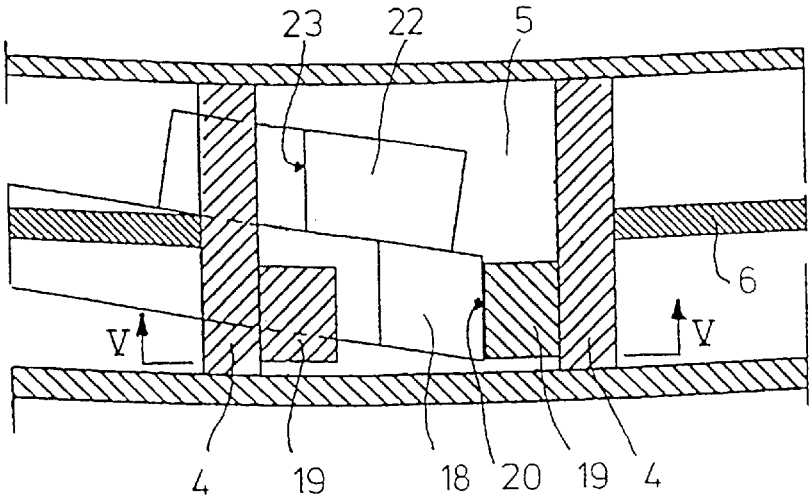
FIG. 6 is a sectional view along the line VI—VI in FIG. 5.

FIGS. 5 and 6 illustrate the design of the nose portion 18 of the pawl arrangement 9 and the co-operating abutment element 19 in the aperture 5. The nose portion 18 has a front abutment surface 20, said surface being pushed against a corresponding surface on the abutment element 19 when the piston rod 16 of the hydraulic cylinder 8 is pushed out. The abutment force will act in the direction of attack 21 through the pivot axis 14 of the pawl arrangement. The abutment surface 20 on the nose 18 of the pawl arrangement defines an angle $\alpha$ with perpendicular to the direction of attack 21, such that the contact force between the abutment surface 20 on the pawl and the abutment element 19 will have a component attempting to push the pawl out of the aperture 5. In operation, this outwardly directed force is resisted by the arrangement, partly because of the friction between the pawl and the abutment element, and partly because of a force applied by the swinging cylinder 17. The purpose of this design is to automatically bring the pawl arrangement out of the engagement with the rim on the turret, in order for the ship to turn freely with regard to the turret, if the hydraulic system of the arrangement according to the invention should fail, for example during an emergency situation in difficult and abruptly changing weather conditions. On the other hand, if the turret should remain locked with regard to the ship in a such situation, a turning of the ship because of changing weather conditions could lead to a corresponding twisting of risers and similar equipment related to the turret, with a corresponding risk of fractures and uncontrolled releases.

The size of the angle a depends on several factors, such as choice of material, surface finish and possible use of lubricants on the abutment surfaces. Usually it will be in the range 5°–12°. The system can also be constructed with frictional forces being larger than the outwardly directed force component. In this case, the swinging cylinder 17 must have an accumulator based emergency release system, in order to actively help the pawl arrangement to be pulled out of the engagement in case of failure of the normal hydraulic feed.

The nose portion 18 of the pawl arrangement is on one side provided with a shoe 22, having a rear surface 23 engaging with the surface 24 of one of the blocks 4 limiting the opening 5 when the piston rod 16 of the hydraulic cylinder 8 is drawn inwardly. Preferably, the surface 23 forms such an angle to the force attacking direction 21 that the pawl may be pulled out of the possible engagement with the block 4 without the use of a large force in an emergency situation.

Figure 7:
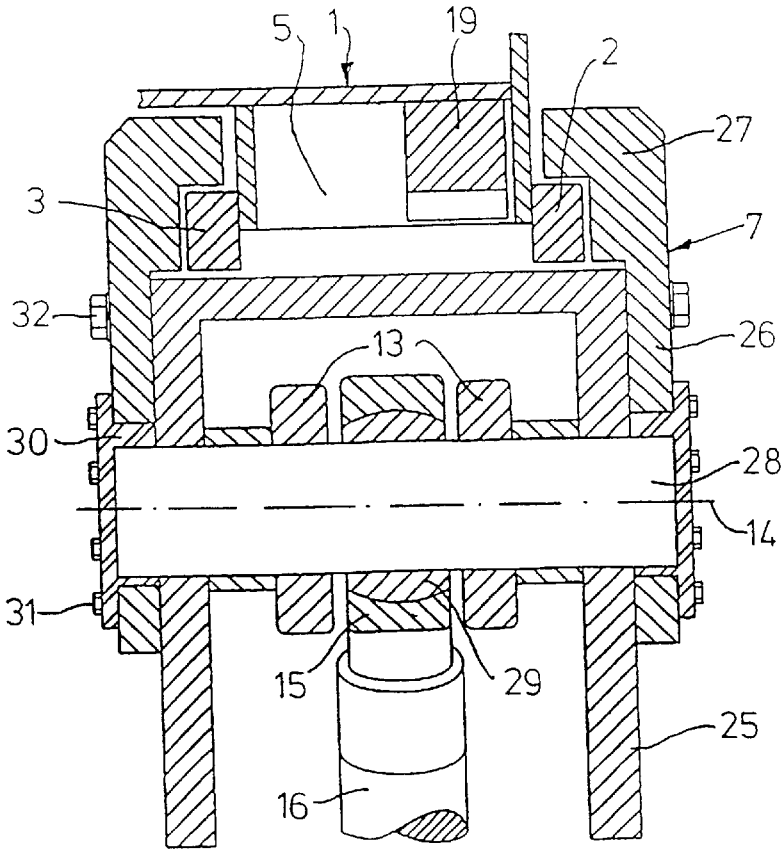
FIG. 7 is a sectional view along the line VII—VII in FIG. 2.

A vertical section through the slide 7 is shown in FIG. 7. The slide comprises a housing 25 being substatially shaped as an inverted U. The housing is provided with side walls 26, each having an upwards extending angled portion 27 engaging around each of the rings 2,3 on the rim 1 and thereby defining guides for these.

Furthermore, the housing 25 is provided with bores for a pin 28 providing support for the pawl arrangement, here denoted 13, and the attachment lug 15 of the piston rod 16 of the hydraulic cylinder 8. The attachment lug has a spherical support 29 in order for the piston rod 16 to adopt a varying angle with the pin 28 during the movement of the piston rod 16.

The side wall 26 also has bores for the pin 28, but these have a larger diameter than the pin and receives a flanged bushing 30 having an eccentric hole with the same diameter as the pin. The flange of the bushing is provided with a number of fixing screws 31, and when all these are removed, the bushing 30 can be rotated stepwise and thereby cause a small displacement of the respective side walls 26 in relation to the housing 25. Thereby the clearance between the angled portion 27 and the respective ring 2, 3 is adjusted for production tolerances and the like. After adjustment of the position of the side walls 26, the bushing is locked to the housing by means of fixing bolts 32, extending through oversized holes (not shown) in the side walls 26.

It will be understood that the arrangement according to the invention is connected to a suitable hydraulic system, and has a control system that allows for both automatic and manual operation. In addition, the control system is such that the two diametrically opposite arrangments (see FIG. 1) can be used synchronized or independently of each other. Such systems are well known to the person skilled in the art and need no further description.

The arrangement according to the invention is primarily intended for turning of a turret arranged on a ship for offshore production of oil and gas, but can also be used for other purposes where relative displacement of heavy units is to occur under controlled conditions. The system is based on welded structures that can be arranged in a simple manner without machined parts.

When the turret is used on a production ship, there will be a need to turn the turret with respect to the ship when the ship changes its position during changing weather and current conditions. After a such rotation, it is desireable to lock the turret with respect to the ship until a new situation requires the turret to be turned. The present invention combines both turning and locking of the turret in one and the same function.

When the turret is to be turned, it will usually be enough to utilize one of the hydraulic cylinders 8 of the arrangement for the active turning, and usually it will only be necessary to use one of the arrangements while the diametrically opposite arrangement is passive and on standby. Based on the situation shown in FIG. 2, where the pawl arrangement 9 is engaged with the rim 1 while the ratched arrangment 13 is free, the right hydraulic cylinder 8 is used to push the rim towards the right until the piston rod 16 reaches its extended end position. Then the pawl arrangement 13 is brought to engagement with a suitable aperture 5 in the rim 1, whereupon the left hydraulic cylinder 8 is locked in order to fix the rim and thereby the turret in this position. In the next step, the pawl arrangement 9 is released from the rim, and the right hand hydraulic cylinder 8 pulls the piston rod 16 inwardly in order to bring the slide 7 back to the position shown in FIG. 2. Now the pawl arrangement 9 is engaged with another aperture 5, whereupon the pawl arrangment 13 is pulled out of its engagement for releasing the turret and making a new movement with the help of the right hydraulic cylinder 8 possible. When the desired rotation of the turret is reached, both pawl arrangements 9, 13 can remain in engagement with the hydraulic cylinders 8 locked. It is of course also possible to move the turret by letting the hydraulic cylinder 8 pull instead of push. However, this will represent a less efficient use of the hydraulic cylinder because its piston area is smaller on the pulling side (piston rod side) than the pushing side. Furthermore, a pushing force will have an upwardly directed vertical component that to some degree will reduce the load, and thereby the friction, in the support of the turret, while a pushing force will have the opposite effect. In addition, the power transfer to the deck 12 of the ship will be most favourable in pushing.

Also in other respects, the power transfer will occur in a favourable way. The force attacking direction 21 through the pawl arrangement (FIG. 5) will mainly form an extension of the piston rod 16 of the hydraulic cylinder 8, and the force from the piston rod will be transferred to the pawl arrangement through a short part of the pin 28. The result is that no significant forces are created between the slide 7 and the rings 2, 3 of the rim, and thereby the risk of wear and flattening of these elements is reduced. The only parts that are exposed to any wear, are therefore the nose portion 18 of the pawl arrangement and the abutment elements 19. The abutment surface 20 on the pawl arrangement can rather easily be refinished by grinding, or also be provided with a coating having high wear resistance. The abutment elements 19 can easily be replaced, because they are kept in place by a clamping piece 33 (FIG. 5), fixed by means of screws (not shown) and pushing the abutment elements 19 against the respective block 4. The abutment elements 19 are easy to fit to the block 4, the latter not having to be welded with great precision or undergo any post-treatment. It will be seen that the abutment elements are not arranged on the side of the aperture 5 that cooperates with the shoe 22 of the pawl. This is because the pulling function usually is not utilized, thus making the precise adaption of the abutment surface of the block 4 to the back surface 23 of the shoe 22 less important. However, in principle, abutment elements can also be installed on the pulling side without difficulty.

Although the invention in the foregoing has been described in relation to a specific embodiment, it will be obvious to the person skilled in the art that the invention can be modified and variations can be made, without departing from the idea of the invention and the scope of the ensuing claims.

What is claimed is:

1. An arrangement for turning a turret on a ship characterized in that the turret is provided with a rim having a flange arrangement which is provided with at least one slide that can glide along the flange arrangement and optionally be locked on the rim, the slide being driven by a hydraulic cylinder acting between the slide and the structure of the ship, the slide, together with the related hydraulic cylinder forming one unit of a pair of such units, the two units acting in substantially opposite directions on the rim and preferably being controlled by a mutual control system that can cause one of the hydraulic cylinder units to remain locked while the other unit is moved by its hydraulic cylinder, the slide being lockable to the rim by means of a pawl arrangement which is rotatably mounted on the slide and can engage with apertures in the rim.

2. An arrangement according to claim 1, characterized in that the hydraulic cylinder engages the pawl arrangement at the axis of rotation of the pawl arrangement in the slide.

3. An arrangement according to claim 2, characterized in that a connecting line between the axis of rotation in the slide of the pawl arrangement in the slide and its point of attack on the rim, substantially forms an extension of the longitudinal axis of the associated hydraulic cylinder.

4. An arrangement according to claim 2, characterized in that the slide is positioned substantially underneath the rim.

5. An arrangement according to claim 4, characterized by that the apertures in the rim are provided with abutment elements for cooperation with a nose portion on the free end of the pawl arrangement.

6. An arrangement according to claim 5, characterized in that said nose portion has a front abutment surface for cooperation with the abutment element, the front abutment surface defining a small angle with a perpendicular to a connecting line between the axis of rotation of the pawl arrangement in the slide and a mid point of the abutment surface, the angle being such that an abutment force between the abutment surface and the abutment element has a component trying to drive said nose portion out of the aperture in the rim.

7. An arrangement according to claim 6, characterized in that the angle is in the range 5°–12°.

8. An arrangement according to claim 6, characterized in that the pawl arrangement, at its nose portion, is provided with a shoe having a rear surface for cooperation with a limiting surface of the aperture.

9. An arrangement according to claim 2, characterized in that the slide comprises an open housing, the housing receiving a pin which provides support for a two-branched end of the pawl arrangement and an attachment lug, being arranged between the branches of the pawl arrangement, for the piston rod of the hydraulic cylinder, the attachment lug preferably comprising a spherical bearing.

10. An arrangement according to claim 9 further comprising external side walls which cooperate with the housing to provide a guide for the flange arrangement.

11. An arrangement according to claim 10, wherein the side walls are adjustably mounted on the housing.

12. An arrangement according to claim 11 comprising eccentric bushings rotatably mounted on the pin, and wherein the side walls are positioned to bear against the bushings so that rotation of the bushings will vary the positions of the side walls relative to the flange arrangement.

13. An arrangement according to claim 2 characterized in that a connecting line between the axis of rotation of the pawl arrangement in the slide and its point of attack on the rim substantially forms an extension of the longitudinal axis of the associated hydraulic cylinder.

14. An arrangement according to claim 2 characterized in that the slide comprises an open housing, the housing receiving a pin which provides support for a two-branched end of the pawl arrangement and an attachment lug, being arranged between the branches of the pawl arrangement, for the piston rod of the hydraulic cylinder.

15. An arrangement according to claim 1 characterized in that a connecting line between the axis of rotation of the pawl arrangement in the slide and its point of attack on the rim, substantially forms an extension of the longitudinal axis of the hydraulic cylinder.

16. An arrangement according to claim 15, characterized in that the slide is positioned substantially underneath the rim.

17. An arrangement according to claim 15, characterized by that the apertures in the rim are provided with abutment elements for co-operation with a nose portion on the free end of the pawl arrangement.

18. An arrangement according to claim 1 characterized in that the slide is positioned substantially underneath the rim.

19. An arrangement according to claim 1 characterized by that the apertures in the rim are provided with abutment elements for cooperation with a nose portion on the free end of the pawl arrangement.

20. An arrangement according to claim 19, characterized in that said nose portion has a front abutment surface for cooperation with the abutment element, the front abutment surface defining a small angle ($\alpha$) with a perpendicular to a connecting line between the axis of rotation of the pawl arrangement in the slide and a mid point of the abutment surface, the angle being such that an abutment force between the abutment surface and the abutment element has a component trying to drive said nose portion out of the aperture in the rim.

21. An arrangement according to claim 20, characterized in that the angle ($\alpha$) is in the range 5°–12°.

22. An arrangement according to claim 19, characterized in that the pawl arrangement at its nose portion, is provided with a shoe having a rear surface for cooperation with a limiting surface of the aperture.

23. An arrangement according to claim 1 characterized in that the slide comprises an open housing, the housing receiving a pin which provides support for a two-branched end of the pawl arrangement and an attachment lug, being arranged between the branches of the pawl arrangement, for the piston rod of the hydraulic cylinder, the attachment lug preferably comprising a spherical bearing.

24. An arrangement according to claim 23 further comprising external side walls which cooperate with the housing to provide a guide for the flange arrangement.

25. An arrangement according to claim 24 wherein the side walls are adjustably mounted on the housing.

26. An arrangement according to claim 25 comprising eccentric bushings rotatably mounted on the pin, and wherein the side walls are positioned to bear against the bushings so that rotation of the bushings will vary the positions of the side walls relative to the flange arrangement.

27. An arrangement according to claim 1 characterized by a hydraulic cylinder attached to the pawl arrangement and to the slide, the hydraulic cylinder being operated to rotate the pawl on the slide to engage or disengage the slide from the rim of the turret.

* * * * *